US008783478B2

(12) United States Patent
Roodenburg

(10) Patent No.: US 8,783,478 B2
(45) Date of Patent: Jul. 22, 2014

(54) HOISTING CRANE AND OFFSHORE VESSEL

(75) Inventor: Joop Roodenburg, Delft (NL)

(73) Assignee: Itrec B.V., Schiedam (NL)

( * ) Notice: Subject to any disclaimer, the term of this patent is extended or adjusted under 35 U.S.C. 154(b) by 1136 days.

(21) Appl. No.: 12/682,534

(22) PCT Filed: Oct. 11, 2007

(86) PCT No.: PCT/NL2007/000231

§ 371 (c)(1),
(2), (4) Date: Nov. 2, 2010

(87) PCT Pub. No.: WO2009/048316

PCT Pub. Date: Apr. 16, 2009

(65) Prior Publication Data

US 2011/0031205 A1 Feb. 10, 2011

(51) Int. Cl.
*B66C 23/52* (2006.01)

(52) U.S. Cl.
USPC ..... 212/309; 212/232; 212/235; 212/240

(58) Field of Classification Search
CPC ..... B66C 13/06; B66C 13/08; B66C 23/163; B66C 23/82; B66C 23/84
USPC ..... 212/307, 309, 232, 235, 240, 247, 262
See application file for complete search history.

(56) References Cited

U.S. PATENT DOCUMENTS

| | | | | |
|---|---|---|---|---|
| 3,486,635 | A * | 12/1969 | Thomson | 212/310 |
| 4,221,300 | A * | 9/1980 | Rudak et al. | 212/309 |
| 4,919,393 | A | 4/1990 | Calkins | |
| 5,011,333 | A | 4/1991 | Lanan | |
| 5,579,931 | A | 12/1996 | Zuehlke et al. | |
| 5,951,227 | A * | 9/1999 | Calkins et al. | 414/141.7 |
| 6,932,326 | B1 * | 8/2005 | Krabbendam | 254/334 |
| 7,182,212 | B2 * | 2/2007 | Frumau et al. | 212/307 |
| 7,328,811 | B2 * | 2/2008 | Roodenburg et al. | 212/252 |
| 2007/0084814 | A1 * | 4/2007 | Roodenburg et al. | 212/252 |
| 2007/0084815 | A1 * | 4/2007 | Roodenburg et al. | 212/252 |
| 2007/0098504 | A1 * | 5/2007 | Roodenburg et al. | 405/166 |

FOREIGN PATENT DOCUMENTS

| | | | |
|---|---|---|---|
| DE | 2642910 | A1 | 3/1978 |
| DE | 10016021 | A1 | 10/2001 |

(Continued)

OTHER PUBLICATIONS

"Cascade and Chinook, Developing the Lower Tertiary with the First FPSO in the U.S. Gulf of Mexico", Supplement to Oil and Gas Journal, Penn Well Custom Publishing, 2012.

*Primary Examiner* — Emmanuel M Marcelo
(74) *Attorney, Agent, or Firm* — Birch, Stewart, Kolasch & Birch, LLP

(57) ABSTRACT

A hoisting crane comprising a substantially hollow vertical column, a jib, a jib winch and a jib hoisting cable is provided. The crane further a hoisting winch and an associated hoisting cable, the hoisting winch being disposed in the column, so that the hoisting cable extends from the winch through the column. The jib winch and the hoisting winch are arranged on a rotatable winch support, such that the winch support is mounted movable with respect to the vertical column. The hoisting crane further comprises a deep water winch positioned below the rotatable winch support and an associated deep water cable for raising and lowering a load extending through the rotation axis of the rotatable winch support, so that the deep water cable extends from the deep water winch through the hollow vertical column. The present invention further relates to a vessel provided with such a crane.

18 Claims, 4 Drawing Sheets

(56) References Cited

FOREIGN PATENT DOCUMENTS

Figure 1:
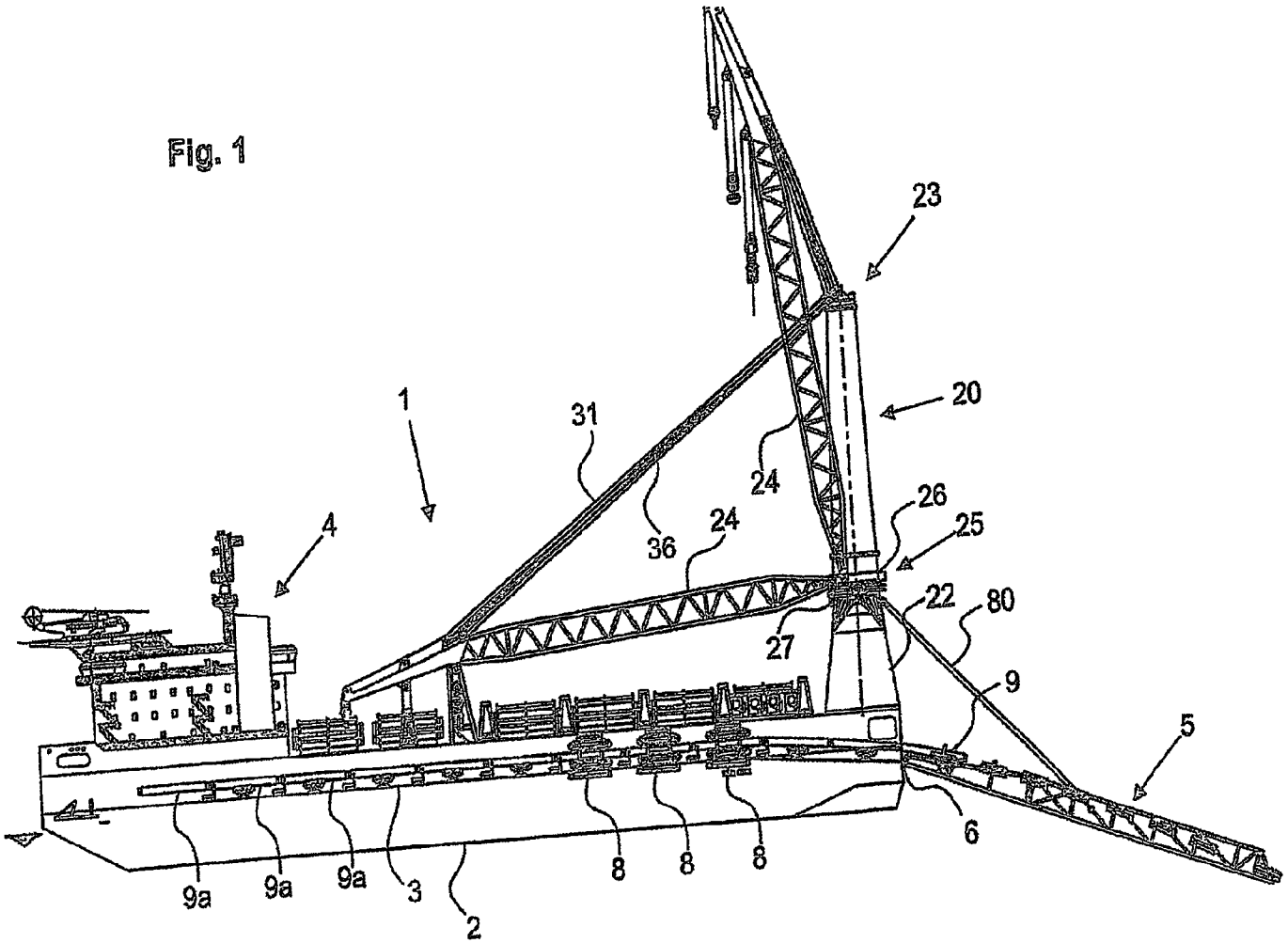

| | | | |
|---|---|---|---|
| EP | 1063163 | A2 | 12/2000 |
| GB | 2025349 | A | 1/1980 |
| NL | 8104269 | A | 4/1983 |
| NL | 8503094 | A | 6/1987 |
| WO | WO 2005/123566 | A2 | 12/2005 |

* cited by examiner

HOISTING CRANE AND OFFSHORE VESSEL

The invention relates to a hoisting crane. Such a hoisting crane has previously been described by the applicant in PCT/NL2005/000443.

A disadvantage of such known hoisting cranes is that the range of loads that can be hoisted at a desired hoisting rate is limited. The winch and hoisting cable of the hoisting crane determine its capacity. With reeved hoisting cables heavier loads can be hoisted, but at a lower rate. In order to hoist heavier loads at the same rate, the required weight and dimension of the hoisting cable and winch increase rapidly. This is the reason why for known hoisting cranes a compromise of hoisting cable, winch and capacity of the crane has to be chosen.

It is an object of the invention to propose an improved hoisting crane. To this end, the invention provides a hoisting crane comprising a deep water winch positioned below the rotatable winch support and an associated deep water cable for hoisting a load extending through the center of the rotatable winch support, so that the deep water cable extends from the deep water winch through the hollow vertical column to the top cable guide and then to a hoisting cable guide on the jib.

An advantage of such a crane is that the range of loads that can be hoisted at a desired hoisting rate is increased due to the applicability of the combination of hoisting means and a deepwater lowering system. The conventional hoisting system allows hoisting of loads with increasing weight at decreasing hoisting rate, and the deepwater lowering system specifically allows hoisting of relatively large weight loads over large distances (in deep water) with a reasonable hoisting rate. A deepwater lowering system according to the invention typically comprises a high-capacity winch and a cable having a relatively large diameter, in a preferred embodiment a cable having a diameter of up to 109 mm and a length of up to 4000 meters.

In a preferred embodiment, the deep water winch is mounted in a fixed orientation with respect to the vertical column. Because the deep water cable for hoisting a load extends through the center of the rotatable winch support, the deep water system is operable at any orientation of the jib.

In an alternative embodiment, the deep water winch is arranged on a movable deep water winch support, which is mounted moveable with respect to the vertical column. This embodiment is less preferred since the large mass of the deep water winch limits its movability considerably.

Further advantageous embodiments are described in the dependent claims and in the following description with reference to the drawing.

Figure 2:
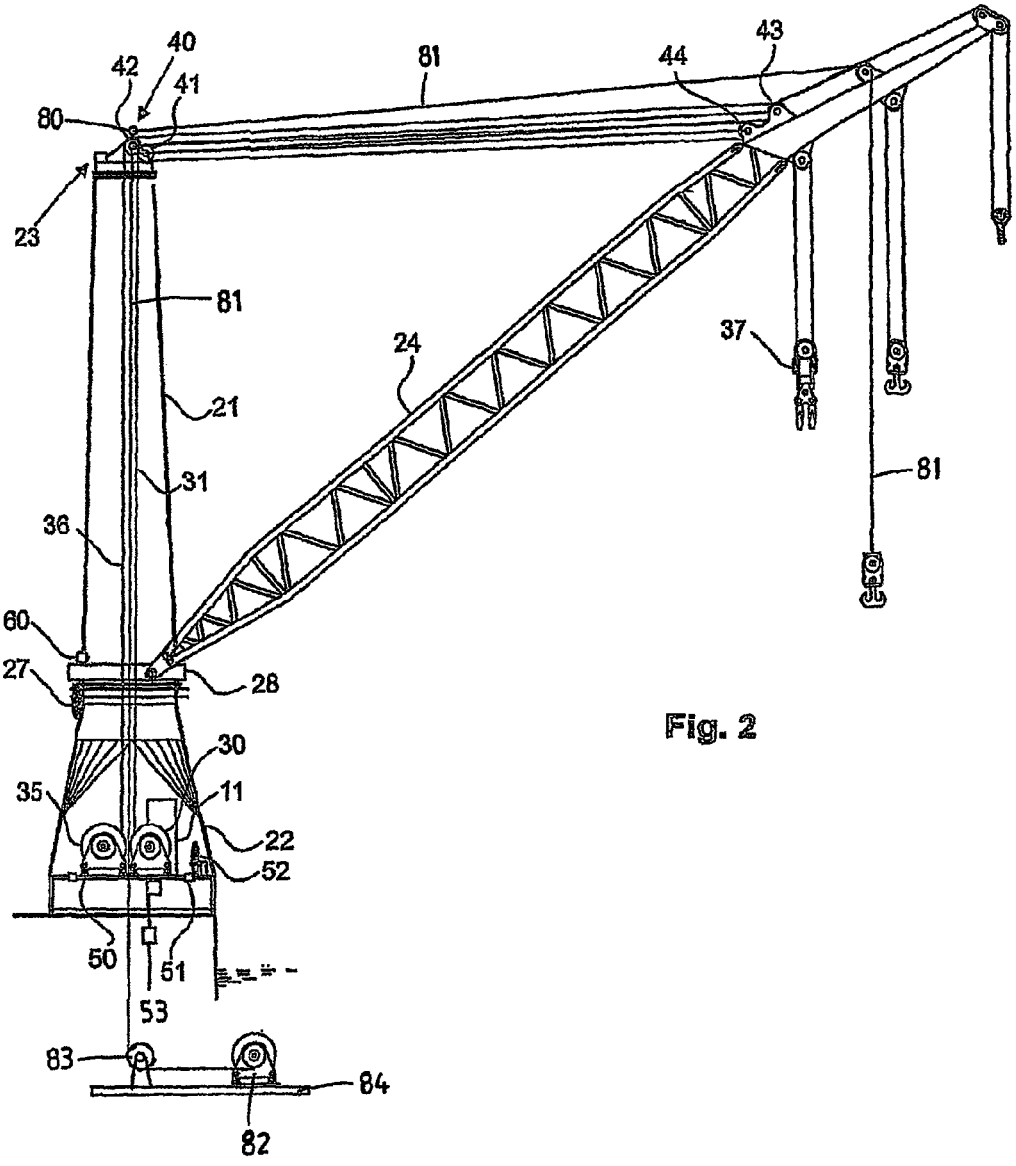
Figure 3:
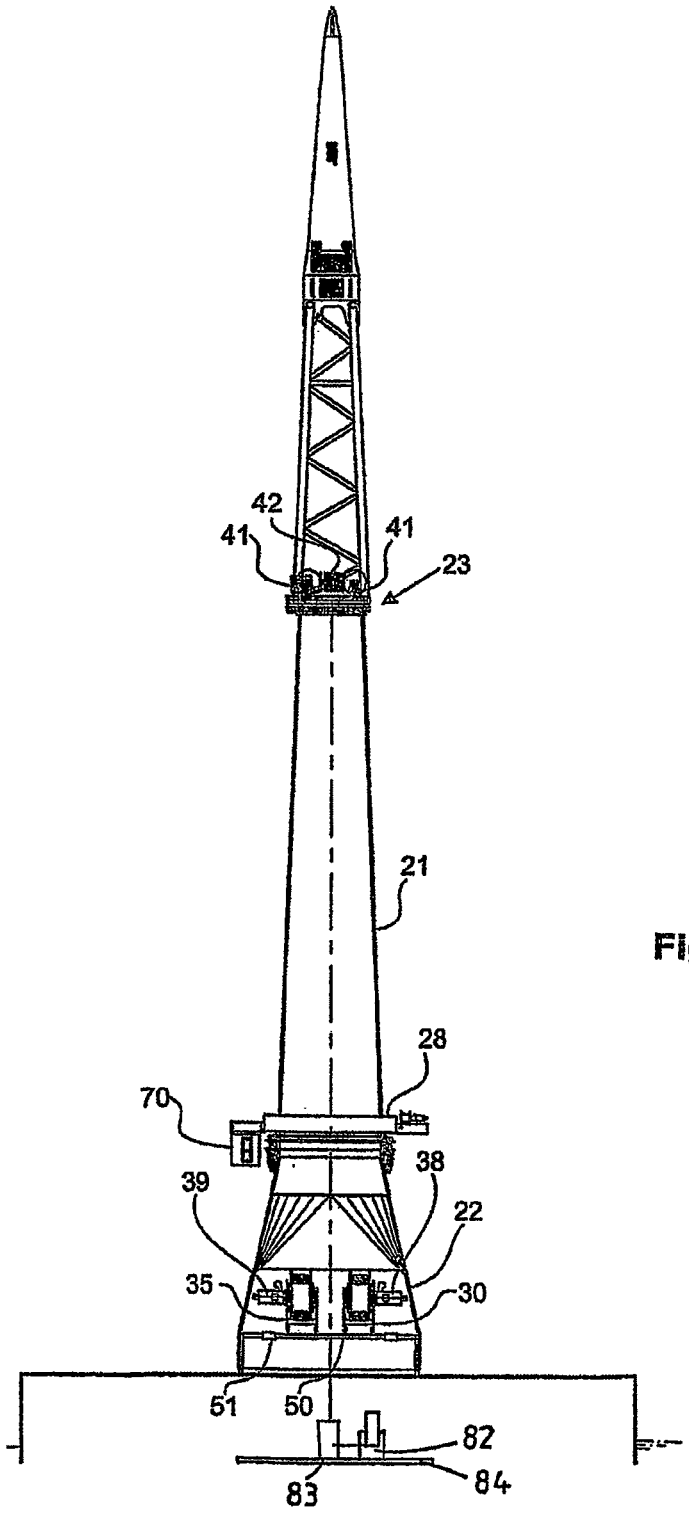
Figure 4:
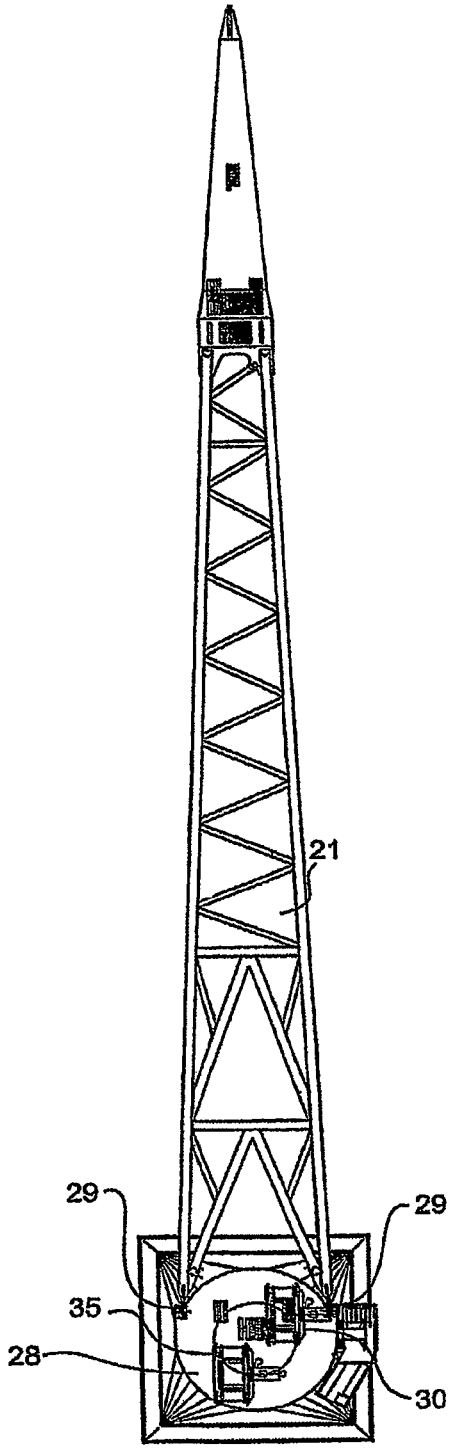

In the drawing:

FIG. 1 diagrammatically depicts an offshore vessel which is suitable, inter alia, for laying a pipeline on the seabed, FIG. 2 shows the hoisting crane at the rear side of the vessel shown in FIG. 1, partially in the form of a cut-away view, FIG. 3 shows the hoisting crane from FIG. 2 from a different direction, FIG. 4 shows a view of the hoisting crane shown in FIGS. 2 and 3 from above.

FIG. 1 shows an offshore vessel 1 which is suitable, inter alia, for laying a pipeline on the seabed. Obviously the vessel could also be of a different type, e.g. a semi-submersible. The vessel could also be a platform, such as a tension leg platform or otherwise.

The vessel 1 has a hull 2 with a working deck 3 and, at the front of the hull 2, a superstructure 4 for crew accommodation, etc.

The vessel 1 is provided with a pipeline-laying installation of the S-lay type, with one or more welding stations on the working deck 3, for coupling pipeline sections 9*a* in a substantially horizontal orientation. On the working deck 3 there are also what are known as tensioners 8 for carrying the weight of the pipeline 9 which is hanging downwards from the vessel 1.

Furthermore, the vessel 1 has a stinger 5 which projects outside the hull 2 of the vessel 1 at the rear side of the vessel 1, engages on the hull 2 at an engagement point such that it can pivot about a substantially horizontal pivot structure 6 and forms a downwardly curved support for pipeline moving towards the seabed.

Furthermore, the vessel 1 has a hoisting crane 20 according to the invention, in this embodiment disposed in the vicinity of the same side of the hull as the stinger 5, which hoisting crane 20 has a vertical structure fixed to the hull 2. The hoisting crane 20 will be described in more detail below. Here, the crane 20 is disposed above the location where the pipeline 9 leaves the working deck 3, on the longitudinal axis of the vessel 1.

The hoisting crane 20, which is illustrated in detail in FIGS. 2-4, has a substantially hollow vertical column 21 with a foot 22, which in this case is fixed to the hull 2 of the vessel 1. Furthermore, the column 21 has a top 23.

The hoisting crane 20 has a jib 24, which is illustrated in two different positions in FIG. 1. An annular bearing structure 25 extends around the vertical column 21 and guides and carries a jib connection member 26, so that the jib connection member 26, and therefore the jib 24, can rotate about the column 21.

In this case, the jib connection member 26 forms a substantially horizontal pivot axis, so that the jib 24 can also be pivoted up and down. There is at least one drive motor 27 for displacing the jib connection member 26 along the annular bearing structure 25. By way of example, the annular bearing structure 25 comprises one or more guide tracks which extend around the column 21 and on which an annular component 28 of the jib connection member 26 is supported via running wheels. Jib securing supports 29 are arranged on the component 28 at two positions. The drive motor 27 may, for example, drive a pinion which engages with a toothed track around the column 21.

To pivot the jib 24 up and down, there is a topping winch 30 provided with a topping cable 31 which engages on the jib 24.

Furthermore, the hoisting crane 20 comprises a hoisting winch 35 for raising and lowering a load, with an associated hoisting cable 36 and a hoisting hook 37.

According to the invention, the hoisting crane 20 comprises a deep water winch 82 and an associated deep water cable 81 for raising and lowering a load. In the shown embodiment the deep water cable 81 is guided via a lower cable pulley assembly 83. Preferably, such deep water winch and cable allow the lowering of subsea structures to water depths of at least 1000 meters, more preferably up to 3000 meters.

Such deep water winch and deep water cable may preferably be embodied as an abandonment and recovery (A&R) winch and cable. Such A&R winch and cable is used in pipe lay operations to be able to abandon and recover a previously launched pipeline. For such purposes, it is required that the entire weight of the previously launched pipeline is suspended from an A&R wire.

At the top 23 of the column 21 there is a top cable guide 40 provided with a cable pulley assembly 41 for the topping cable 31, and with a cable pulley assembly 42 for the hoisting cable 36, and with a cable pulley assembly 80 for the deep water cable 81.

One or more cable pulley assemblies 43 for the hoisting cable 36 and/or the deep water cable 36 and a cable pulley assembly 44 for the topping cable 31 are arranged on the jib 24. The number of cable parts for each cable can be selected as appropriate by the person skilled in the art.

The winches 30 and 35 are in this case disposed in the foot 22 of the vertical column 21, so that the topping cable 31 and the hoisting cable 36 extend from the associated winch 30, 35 upward, through the hollow vertical column 21 to the top cable guide 40 and then towards the cable guides 43, 44 on the jib 24.

The top cable guide 40 has a rotary bearing structure, for example with one or more running tracks around the top of the column 21 and running wheels, engaging on the running tracks, of a structural part on which the cable pulley assemblies are mounted. As a result, the top cable guide 40 can follow rotary movements of the jib about the vertical column 21 and adopt substantially the same angular position as the jib 24.

The top cable guide 40 may have an associated drive motor assembly which ensures that the top cable guide 40 follows the rotary movements of the jib 24 about the column 21, but an embodiment without drive motor assembly is preferred.

The jib winch 30 and the hoisting winch 35 are arranged on a rotatable winch support 50, which is rotatable about a rotation axis substantially parallel with the vertical column 21. The rotatable winch support 50, which is mounted movably with respect to the vertical column 21. The winch support 50 here is located in the vertical crane structure, preferably in the region of the foot 22 under the circular cross section part of the column 21, and is mechanically decoupled from the top cable guide 40. The support 50 could e.g. also be arranged in the hull of the vessel below the column, e.g. the foot could have an extension which extends into the hull.

In the example shown, the winch support 50 is a substantially circular platform which at its circumference is mounted in an annular bearing 51, with the winches 30, 35 arranged on the platform. The annular bearing 51 is in this case such that the platform can rotate about a vertical axis which coincides with the axis of rotation of the top cable guide. The bearing can have any appropriate design including trolleys running along a circular track.

The rotatable winch support 50 has an associated drive motor assembly 52 for moving the winch support 50, in such a manner that the winch support 50 maintains a substantially constant orientation with respect to the jib 24 in the event of rotary movements of the jib 24 about the vertical column 21. The orientation of the winch support 50 with respect to the top table guide 40 likewise remains substantially constant, since its movements are once again the consequence of rotary movements of the jib 24.

According to the present invention, the deep water winch 82 is positioned below the rotatable winch support 50.

The deep water winch 82 may be embodied as a linear winch, or a traction winch, or any other suitable type of winch.

Preferably, the deep water winch 82 and associated or integrated storage drum for the deep water cable is positioned in the hold of the vessel. Preferably, the deep water winch and associated or integrated storage drum is positioned as low as possible due to its large weight. The deep water winch 82 and the cable pulley assembly 83 are mounted on a deep water winch support 84, which is preferably mounted in a fixed orientation with respect to the vertical column 21,22.

Alternatively, the deep water winch support is mounted moveable with respect to the vertical column 21, 22. In a possible embodiment, it is envisaged to connect the movable deep water winch support 84 to the rotatable winch support 50 of the jib winch and the hoisting winch 30, 35, such that the supports 84,50 are movable synchronously.

The associated deep water cable 81 extends from the deep water winch 82 through the rotation axis of the rotatable winch support, which is in this case through the center of the rotatable winch support 50, to the top cable guide and then to a hoisting cable guide on the jib.

In the embodiment shown, there is an angle sensor 60 for detecting the position of the component 28 of the jib connection member 26 with respect to the vertical column 21, the drive motor assembly 52 of the winch support 50 having associated control means 53 which are in operative contact with the angle sensor 60.

The winches 30, 35 each have an associated electrical (or electro-hydraulic) winch drive motor assembly 38, 39 which is disposed on the rotatable winch support 50. The electrical energy required is supplied by generators disposed elsewhere on the vessel, at a distance from the rotatable winch support 50. One or more sliding contacts (not shown) are provided in the electrical connection between these generators and the winch drive motor assemblies 38, 39.

In a variant which is not shown, the winch support 50 can rotate about a vertical shaft, this shaft being provided with one or more sliding contacts. In such an embodiment, the deep water cable extends trough the centre of such shaft.

Via the one or more sliding contacts, a power current supply is preferably fed to the electrical equipment on the winch support 50.

The hoisting crane 20 is provided with a cab 70 for a hoisting crane operator, which cab 70 is in this case carried by the annular bearing structure 25 to which the jib 24 is secured, so that the cab 70 can rotate with the jib about the vertical column 21.

In the cab 70 there are at least control members (not shown) for operating the winch 35 of the hoisting cable 36 and for operating the winch 30 of the topping cable 31. The winch drive motor assemblies 38, 39 have associated control means (not shown) which are in wireless communication with the associated control members in the cab 70. By way of example, a plurality of wireless transmission/reception units are disposed around the vertical column, in or in the vicinity of the path of the cab 70 around the vertical column.

The control means, for example electronic control equipment, for the one or more winches on the winch support 50 are preferably also positioned on this winch support 50.

It can be seen from the figures that, as is preferred, the vertical column 21 has a substantially continuous outer wall. In this case, the horizontal section through the vertical column is substantially circular from the jib connection member to the top 23, with the cross section gradually decreasing towards the top of the column. The foot 22 of the column 21 is substantially rectangular, which has the advantage that the foot 22 can easily be secured (by welding or using bolts) to the longitudinal and cross bulkheads of the hull 2 of the vessel 1. In a variant which is not shown, the vertical column is partly or completely a framework of bars.

It can be seen from FIG. 1 that a load-bearing connecting structure 80, which holds the stinger in a desired position, extends between the vertical structure of the hoisting crane 20 at a location above the point of engagement 6 of the stinger 5 on the vessel hull 2 (in this case in the vicinity of the annular bearing structure for the jib 24), and the stinger 5, at a location remote from the point of engagement 6 of the stinger 5 on the vessel hull 2.

Using the vertical structure, here the foot 22, of the hoisting crane 20 as a point of engagement for the structure 80 makes it possible to dispense with additional structural components for holding the stinger in place, such as cantilevers projecting outside the hull 2.

The vessel 1 can be used to lay a pipeline 9, but also for hoisting work, such as the hoisting work carried out, for example, in the offshore industry when installing platforms, underwater installations, etc.

The invention claimed is:

1. A Hoisting crane comprising:

a substantially hollow vertical column with a foot and a top;

a jib;

an annular bearing structure, which extends around the vertical column and guides and carries a jib connection member, so that the jib connection member can rotate about the column, the jib connection member forming a substantially horizontal pivot axis so that the jib can be pivoted up and down;

a topping device configured to pivot the jib up and down, the topping device comprising a jib winch and a jib hoisting cable;

a top cable guide at the top of the vertical column; the top cable guide comprising a rotary bearing structure, so that the top cable guide can follow rotary movements of the jib about the vertical column and adopts substantially the same angular position as the jib;

one or more jib hoisting cable guides on the jib of the hoisting crane; and a hoisting device configured to hoist a load, comprising a hoisting winch and an associated hoisting cable, the hoisting winch being disposed in the foot of the vertical column, so that the hoisting cable extends from the winch through the hollow vertical column to the top cable guide and, then via an associated jib hoisting cable guide of the one or more jib hoisting cable guides, to a hoisting hook, wherein the jib winch and the hoisting winch are arranged on a rotatable winch support, which is rotatable about a rotation axis substantially parallel with the vertical column, such that the winch support is mounted rotatable with respect to the vertical column; the winch support having an associated drive motor assembly for rotating the winch support, in such a manner that the winch support maintains a substantially constant orientation with respect to the jib in the event of rotary movements of the jib about the vertical column, wherein the hoisting crane further comprises a deep water winch positioned below the rotatable winch support and an associated deep water cable for raising and lowering a load extending through the rotation axis of the rotatable winch support, so that the deep water cable extends from the deep water winch through the hollow vertical column to the top cable guide and then, via a deep water cable guide on the jib, to a deep water cable hook, and wherein the top cable guide is provided with a cable pulley assembly for the jib hoisting cable, a cable pulley assembly for the hoisting cable and a cable pulley assembly for the deep water cable.

2. The hoisting crane according to claim 1, wherein the deep water winch is mounted in a fixed orientation with respect to the vertical column.

3. The hoisting crane according to claim 2, in which the vertical column has a substantially continuous outer wall.

4. The hoisting crane according to claim 2, in which the foot of the column is substantially rectangular.

5. The hoisting crane according to claim 2, in which the vertical column is at least in part a framework of bars.

6. The hoisting crane according to claim 1, in which the vertical column has a substantially continuous outer wall.

7. The hoisting crane according to claim 6, in which a horizontal section through the vertical column is substantially circular.

8. The hoisting crane according to claim 7, in which the foot of the column is substantially rectangular.

9. The hoisting crane according to claim 7, in which the vertical column is at least in part a framework of bars.

10. The hoisting crane according to claim 6, in which the foot of the column is substantially rectangular.

11. The hoisting crane according to claim 6, in which the vertical column is at least in part a framework of bars.

12. The hoisting crane according to claim 1, in which the foot of the column is substantially rectangular.

13. The hoisting crane according to claim 12, in which the vertical column is at least in part a framework of bars.

14. The hoisting crane according to claim 1, in which the vertical column is at least in part a framework of bars.

15. The hoisting crane according to claim 1, wherein the deep water winch is arranged on a rotatable movable deep water winch support, which is mounted moveable with respect to the vertical column.

16. The hoisting crane according to claim 15, wherein the rotatable deep water winch support is connected to the rotatable winch support of the jib winch and the hoisting winch such that the supports are rotatable synchronously.

17. The hoisting provided with a hoisting crane according to claim 1.

18. An offshore vessel, suitable, inter alia, for laying a pipeline on the seabed, comprising a hoisting crane according to claim 1, which hoisting crane has a vertical structure fixed to the hull.

* * * * *